US006415756B1

(12) United States Patent
Lee

(10) Patent No.: US 6,415,756 B1
(45) Date of Patent: Jul. 9, 2002

(54) SPHERICAL ROTARY ENGINE VALVE

(76) Inventor: Jung W. Lee, 1235 W. 7th Ave., Vancouver, BC (CA), V6H 1B7

( * ) Notice: Subject to any disclaimer, the term of this patent is extended or adjusted under 35 U.S.C. 154(b) by 0 days.

(21) Appl. No.: 09/619,872

(22) Filed: Jul. 20, 2000

(51) Int. Cl.[7] ..... F01L 7/00
(52) U.S. Cl. ..... 123/190.1; 123/80 BA
(58) Field of Search ..... 123/190.4, 190.8, 123/190.14, 188.9, 80 BA, 188.6, 190.1

(56) References Cited

U.S. PATENT DOCUMENTS

| | | | | |
|---|---|---|---|---|
| 2,745,395 A | | 5/1956 | Genet | 123/190 |
| 2,787,988 A | | 4/1957 | Genet | 123/80 |
| 2,895,459 A | | 7/1959 | Sbaiz | 123/80 |
| 3,730,161 A | | 5/1973 | Deane | 123/190 |
| 3,945,365 A | | 3/1976 | Cook | 123/190 |
| 4,834,038 A | | 5/1989 | Montagni | 123/190 |
| 4,953,527 A | | 9/1990 | Coates | 123/190 |
| 4,989,558 A | | 2/1991 | Coates | 123/190 |
| 5,109,814 A | | 5/1992 | Coates | 123/190.14 |
| 5,230,314 A | | 7/1993 | Kawahara et al. | 123/317 |
| 5,413,073 A | * | 5/1995 | Larson et al. | 123/188.3 |
| 6,006,713 A | * | 12/1999 | Gebauer | 123/188.3 |

* cited by examiner

*Primary Examiner*—Tony M. Argenbright
*Assistant Examiner*—Katrina B. Harris
(74) *Attorney, Agent, or Firm*—Price, Heneveld, Cooper, DeWitt & Litton

(57) ABSTRACT

An internal combustion engine valve comprising a shell having an outer surface. At least a portion of the outer surface is spherical in shape and a further portion of the outer surface is partially convex in shape and partially concave in shape. The shell further defines a hollow interior and includes a core filling the hollow interior. The core being a substance of high thermal conductivity.

32 Claims, 4 Drawing Sheets

SPHERICAL ROTARY ENGINE VALVE

BACKGROUND OF THE INVENTION

The present invention relates to internal combustion engines in general, and in particular relates to rotary spherical engine valves.

Rotary valves for internal combustion engines have previously been provided for use in controlling the flow of intake and exhaust gasses into and from the combustion chamber of such an engine. Some of these valve constructions employ separate rotary valves for the intake and for he exhaust functions. The prior art rotary valve designs have included rotating cylinders or sleeves that control the flow of intake and exhaust gasses. However, these valve designs have not been widely accepted in view of their many limitations and drawbacks. These previous rotary valve mechanisms have been relatively complicated and expensive, they have not provided optimum valve duration and overlap for efficient engine operation, and they have not achieved good volumetric efficiency with the result that performance is relatively poor and fuel consumption and exhaust gas emissions are relatively high. One factor leading to the failure of past rotary exhaust valves has been their continual exposure to the relatively high temperatures of the exhaust gasses.

One important advantage of a rotary valve is the potential for an increase in the intake and exhaust port area to the cylinder, thus contributing to and increased flow of intake air and exhaust gasses. Engine power is a function of the quantity of intake air able to be ingested by the cylinder prior to the compression cycle, and as the airflow increases so does the power and efficiency of the engine. Thus there is a need for a rotary valve that will provide the necessary improvements in intake airflow while being able to withstand the detrimental effects of hot exhaust gasses.

SUMMARY OF THE INVENTION

One aspect of the present invention is an internal combustion engine valve comprising a shell having an outer surface. At least a portion of the outer surface is spherical in shape and a further portion of the outer surface is partially convex in shape and partially concave in shape. The shell further defines a hollow interior and includes a core filling the hollow interior. The core being a substance of high thermal conductivity.

Another aspect of the present invention is an internal combustion engine having at least one combustion chamber with a predefined diameter housing a piston linearly moveable therein in turn throughout successive intake, compression, power, and exhaust strokes, the combination of a rotary valve mounted at a head of the combustion chamber for alternately facilitating the inflow of intake air from an intake manifold during the intake stroke, sealing the cylinder from the intake manifold and an exhaust manifold during the compression and the power strokes, and facilitating the exhaust of exhaust gasses from the cylinder to the exhaust manifold during the exhaust stroke. The rotary valve comprising a shell having an outer surface at least a portion of which is spherical in shape and a further portion of which is partially convex in shape and partially concave in shape. The shell further defines a hollow interior including a core filling the hollow interior. The core being a substance of high thermal conductivity.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
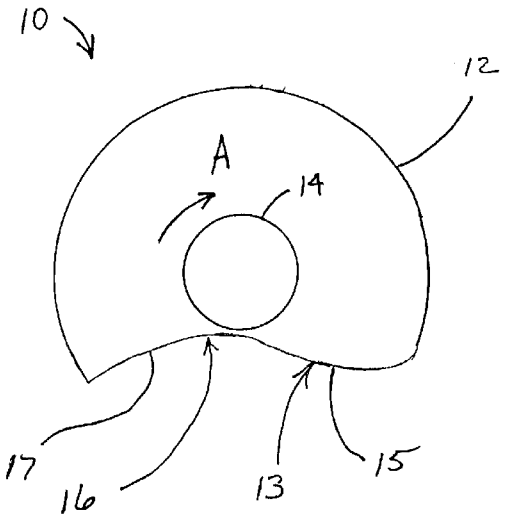
FIG. 1 is an end view of a rotary engine valve embodying the present invention, looking along its axis of rotation.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
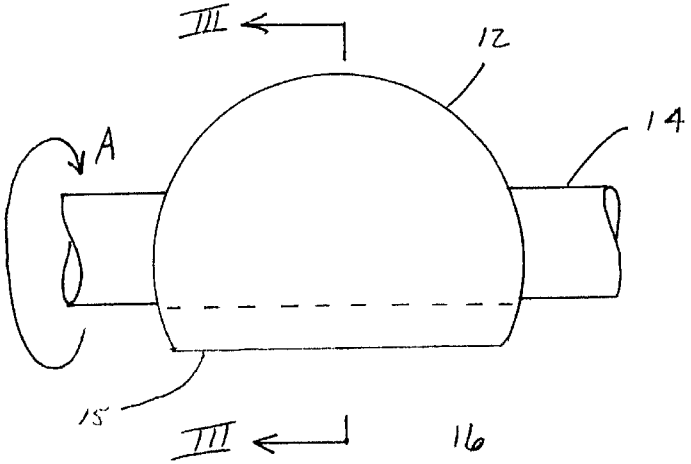
FIG. 2 is an elevation view of the rotary engine valve of FIG. 1 viewed at right angles to its axis of rotation.
Figure 3:
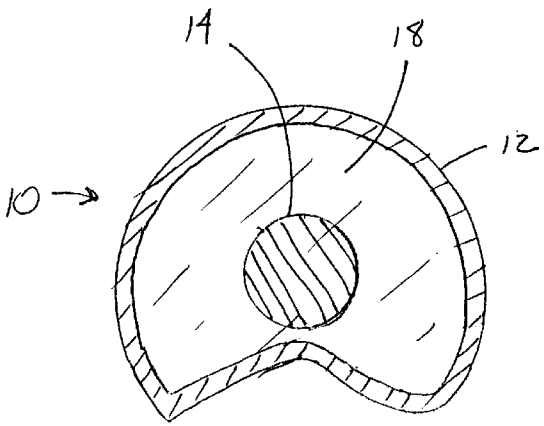
FIG. 3 is an end section view of the rotary engine valve of FIGS. 1 and 2 taken along the line III—III.

Turning to the drawings, FIGS. 1–3 illustrate the rotary engine valve 10 which is one of the preferred embodiments of the present invention, and shows its various components.

Valve 10 comprises a metallic sphere 12 that is mounted on a rotating shaft 14 for rotation thereabout according to directional arrow A. The central axis of shaft 14 passes through the center of sphere 12 for the uniform rotation of valve 10 about shaft 14. One side of sphere 12 is truncated at 15 and the surface 16 described by truncation 15 is formed as an elongated wave 16 which is longitudinally aligned with rotating shaft 14. Wave 16 has a convex portion at the leading edge portion of valve 10, and also has a concave portion 17 at a trailing edge portion of valve 10. Convex portion 13 and concave portion 17 abut in a joining manner proximate to the center of valve 10 to form waveform 16.

FIG. 3 illustrates a cross-sectional view of valve 10 showing spherical element 12 as being a hollow sphere which is filled with a core 18 possessing high thermal conductivity characteristics to assist in the uniform thermal distribution of valve 10. Since valve 10 will have only a portion of its surface area repeatedly exposed to hot exhaust gasses, valve 10 will have non-uniform thermal gradients leading to non-uniform expansion of the valve. Thus, as a result of the non-uniform valve expansion, proper sealing of the valve to the engine head would be extremely difficult and possibly result in adverse blow-by of gasses within the cylinder during the power stroke and decreasing engine power and efficiency. In the preferred embodiment core 18 is a liquid salt which rapidly distributes thermal energy from one side of valve 10 to an opposite side thereby maintaining a constant thermal gradient throughout valve 10 and facilitating uniform expansion of the valve.

Figure 7:
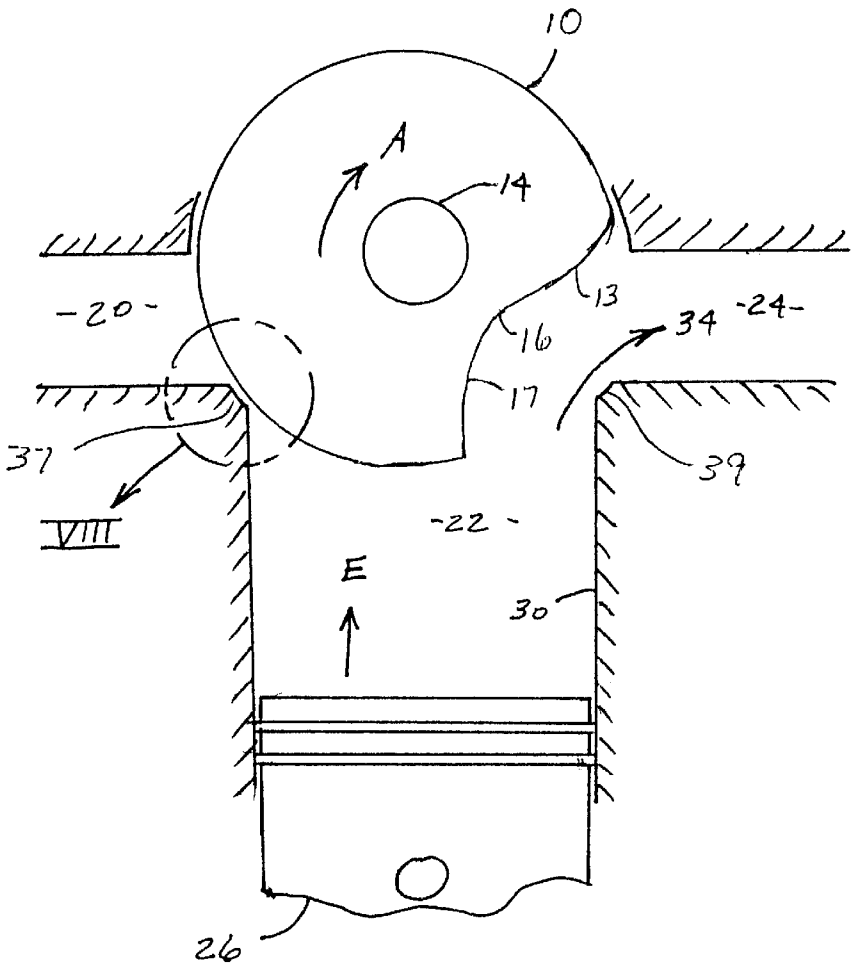
FIG. 7 is a partial sectional view of the rotary valve in an internal combustion engine and its relative position at the beginning of the exhaust stroke of the piston.
Figure 8:
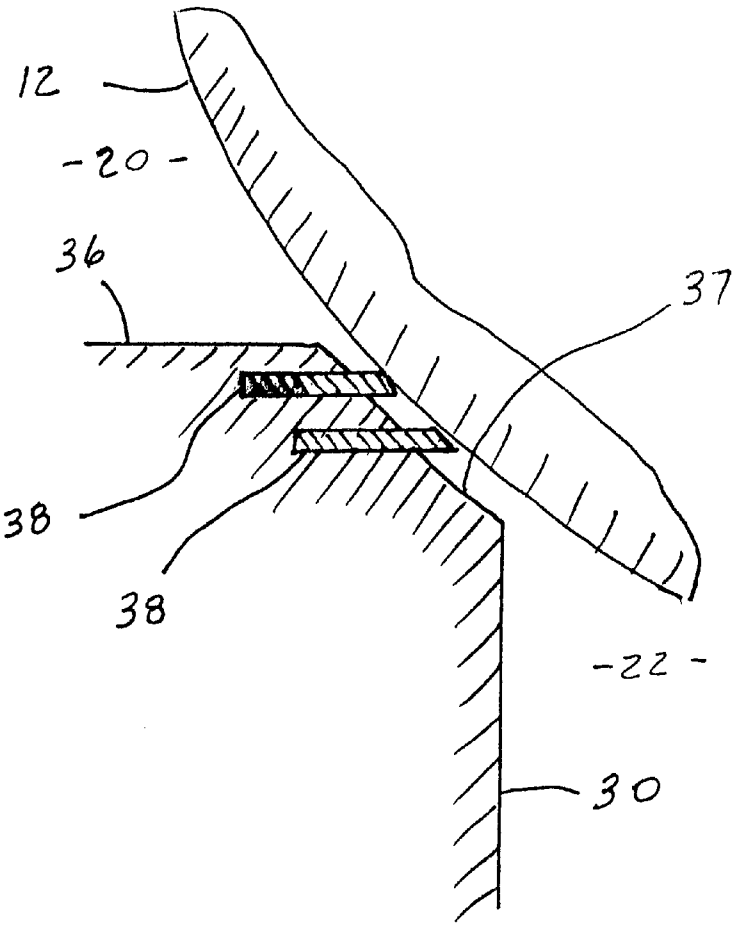
FIG. 8 is an enlarged view of area VIII of FIG. 7 showing the sealing of the valve separating the manifolds from the engine cylinder.

Turning now to FIGS. 4–8, rotary valve is seen installed in an internal combustion engine cylinder 30. Rotary engine valve 10 is seated above engine cylinder 30 on chamfered seat 37 as shown in FIG. 8. Chamfered seat 37 has mounted therein two vertically spaced split rings 38 which function similar to piston rings to provide a seal with valve 10 thereby sealing cylinder 30 from intake and exhaust ports 20 and 24. Rings 38, because they are mounted in the stationary head instead of about the outside of a moving part like the piston, extend inwardly from chamfered seat 37. As valve 10 and rings 38 are broken in, valve 10 can create a much closer seal than can the rings of a piston with respect to the cylinder wall, thus providing a reliable seal between the cylinder and manifold ports 20 and 24.

Figure 4:
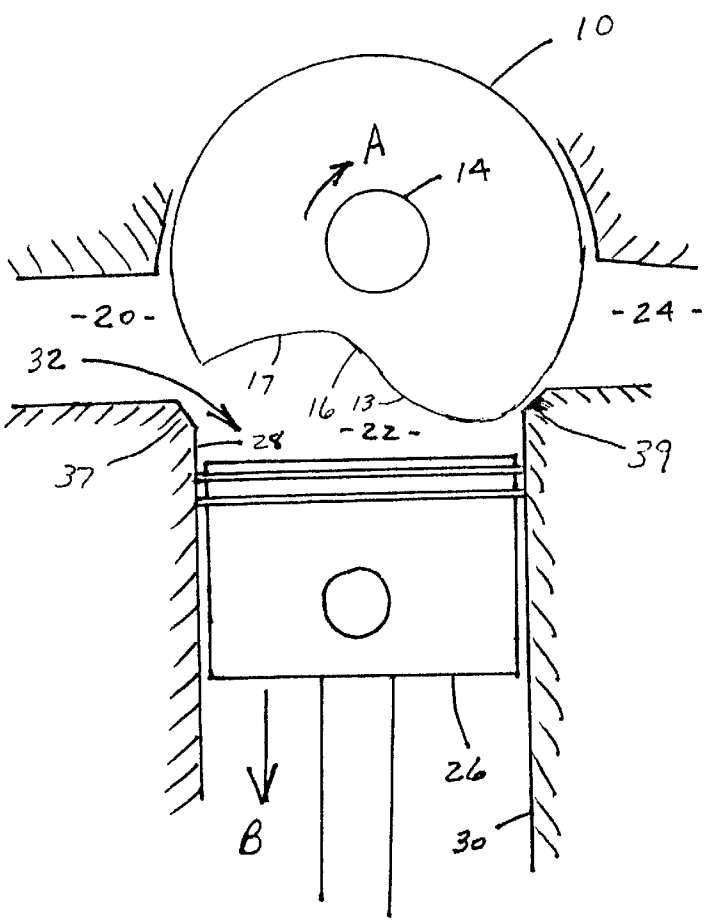
FIG. 4 is a partial sectional view of the rotary valve in an internal combustion engine and its relative position at the beginning of the intake stroke of the piston.

FIGS. 4–7 illustrate the operational theory of rotary engine valve 10. As shown in FIG. 4, wave surface 16 of valve 10 is substantially oriented downward facing piston 26 at the beginning of the intake stroke of piston 26 as shown by directional arrow B. As piston 26 descends in cylinder 30, valve 10 rotates clockwise to permit intake air 32 to be drawn through intake manifold 20 into combustion chamber 22. Concave portion 17 is the first to be exposed to intake port 20. The concavity of portion 17 enhances the volumetric flow of intake air from intake port 20 to cylinder 30. As the convex portion 13 rotates across the upper portion of cylinder 30, the displacement of convex portion 13 begins a slight advantageous compression of the fuel-air mixture in the cylinder prior to the cylinder compression stroke. Fuel is injected into chamber 22 above piston 26 to formulate a combustible fuel/air mixture. The injection sequences are well known in the industry and thus are not illustrated for the sake of clarity.

Figure 5:
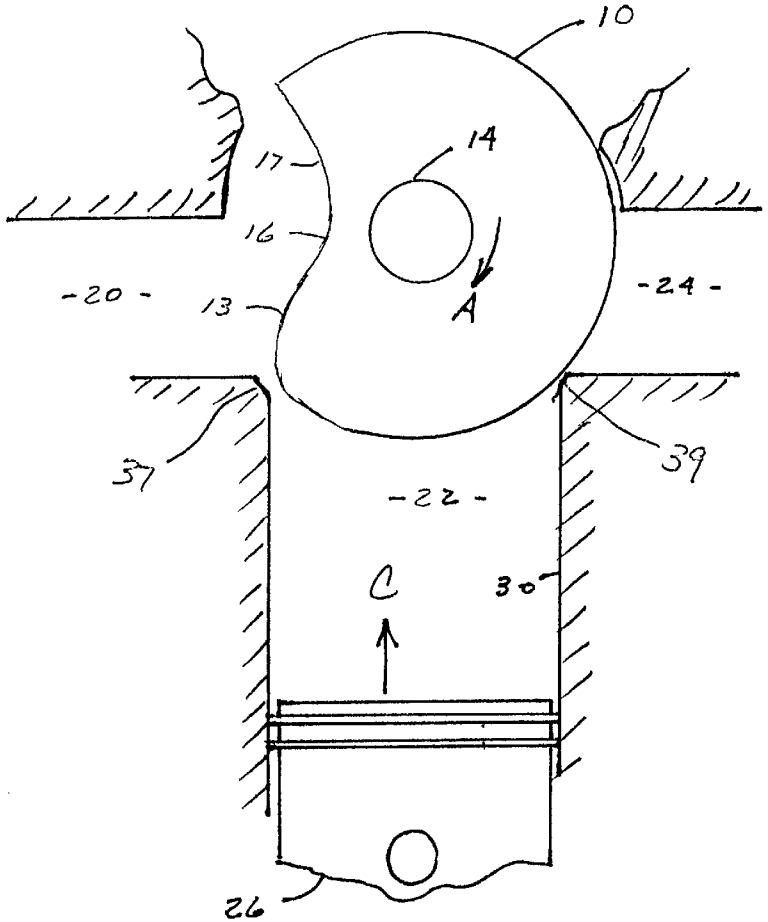
FIG. 5 is a partial sectional view of the rotary valve in an internal combustion engine and its relative position at the beginning of the compression stroke of the piston.

As shown in FIG. 5, once piston 26 reaches the bottom of its intake stroke and begins its upward travel in cylinder 30, it begins compression stroke C. At the beginning of compression stroke C rotary engine valve 10 has rotated such that the concave portion 17 and the convex portion 13 of valve 10 have rotated past intake port valve seat area 37. Spherical surface 12 of valve 10 has sealed off combustion chamber 22 from both intake and exhaust manifolds 20 and 24 at seats 37 and 39 respectively to permit the fuel/air mixture in chamber 22 to be compressed by piston 26.

Figure 6:
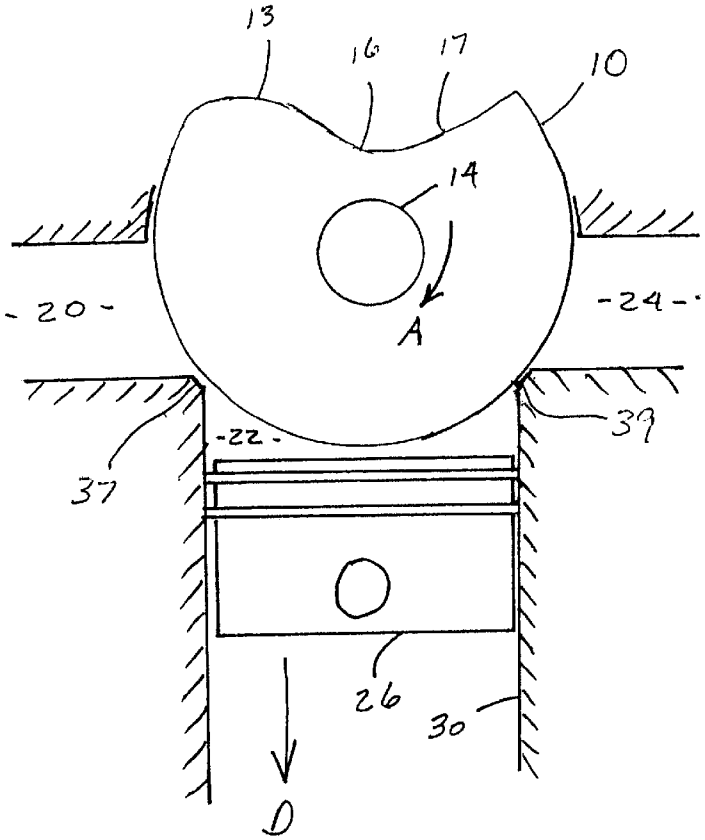
FIG. 6 is a partial sectional view of the rotary valve in an internal combustion engine and its relative position at the beginning of the power stroke of the piston.

FIG. 6 illustrates the power stroke of piston 26. As concave surface 16 continues to rotate about shaft 14, the spherical portion 12 of valve 10 maintains a sealed relationship with seat areas 37 and 39 above cylinder 30. The compressed fuel/air mixture in combustion chamber 22 is ignited by a spark plug (not shown) which begins the downward power stroke D of piston 26. Spherical surface 12 of valve 10 maintains its sealed relationship with rings 38 throughout the power stroke allowing the maximum force from the expanding gasses of the fuel-air mixture ignition to be expended on powering piston 26 downward.

Referring now to FIG. 7, as piston 26 begins its upward exhaust stroke E, concave portion 17 of passes seat area 39 to permit the expulsion of exhaust gasses. The concave form of portion 17 facilitate a rapid opening of maximum area to permit an easy flow of exhaust gasses 34 from combustion chamber 22 to exhaust manifold 24. The increase in area to exhaust manifold 24 results in less power expended by the engine to force exhaust gasses 34 into manifold 24, thereby improving the efficiency of the engine. Thus, rotary engine valve 10 completes one revolution for each firing cycle of piston 26.

A single rotating valve such as valve 10 can replace the complex and expensive assemblies in modern engines of cam shafts, lifters, and the multiple number of valves in each engine cylinder, typically four valves per cylinder. Additionally, since the valve surface is always above the top surface of the piston at top dead center, there is no danger of damaging a piston, or crank shaft should a valve fail, which is typically the case in current engines where valve heads when operating are displaced into the combustion chamber to open the ports to the desired manifolds.

The volumetric intake of air to cylinder 30 can be controlled and optimized by varying the shape of convex and concave surfaces 13 and 17 by varying the width, depth, and geometry of the wave form. Since wave surface 16 does not contact any portion of the engine there are no restrictions on its configuration. The geometry of surface 16 and its rotational synchronization with piston 26 can be adjusted such that the intake occurs at an advanced position before top dead center of the piston and the exhaust valve opening can be retarded before bottom dead center by varying the valve size and the size of surface 16 to optimize the efficiency and power output of the engine.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the Doctrine of Equivalents.

The invention claimed is:

1. An internal combustion engine valve comprising:

a shell having an outer surface at least a portion of which is spherical in shape and a further portion of which is partially convex in shape and partially concave in shape, said shell further defining a hollow interior; and a core filling said hollow interior, said core being a substance of high thermal conductivity.

2. The internal combustion valve according to claim 1 wherein said high thermal conductivity substance is a liquid salt.

3. The internal combustion valve according to claim 1 wherein said convex and said concave portions abut to define a wavelike surface.

4. The internal combustion valve according to claim 3 further including a shaft therethrough, said shaft having a longitudinal axis for rotating thereabout.

5. The internal combustion valve according to claim 4 wherein said shaft axis passes through a center of said spherical shell.

6. The internal combustion engine valve according to claim 1 wherein said concave and convex portions provide said further portion of said shell with a sine-wave cross-section.

7. The internal combustion engine valve according to claim 1 wherein said shell forms a closed interior.

8. In an internal combustion engine having at least one combustion chamber with a predefined diameter housing a piston linearly moveable therein in turn throughout successive intake, compression, power, and exhaust strokes the combination of a rotary valve mounted at a head of said combustion chamber for alternately facilitating the inflow of intake air from an intake manifold during said intake stroke, sealing said cylinder from said intake manifold and an exhaust manifold during said compression and said power strokes, and facilitating the exhaust of exhaust gasses from said cylinder to said exhaust manifold during said exhaust stroke, said valve comprising:

a shell having an outer surface at least a portion of which is spherical in shape and a further portion of which is partially convex in shape and partially concave in shape, said shell further defining a hollow interior; and a core filling said hollow interior, said core being a substance of high thermal conductivity.

9. The internal combustion engine according to claim 8 wherein said high thermal conductivity substance is a liquid salt.

10. The internal combustion engine according to claim 8 wherein said convex and said concave portions abut to define a wavelike surface.

11. The internal combustion engine according to claim 10 further including a shaft therethrough, said shaft having a longitudinal axis for rotating thereabout.

12. The internal combustion engine according to claim 11 wherein said shaft axis passes through a center of said spherical shell.

13. The internal combustion engine according to claim 12 wherein said spherical valve rotates above said cylinder and in combination with a seat, seals said cylinder from said manifolds during said compression and power strokes.

14. The internal combustion engine according to claim 13 wherein said seat further includes:

a chamfered area between said cylinder and said manifolds and defining at least one groove about a circumference of said chamfered area;

at least one sealing ring received within said groove and having an interior edge thereof extending interiorly toward a center of said chamfered circumference, said interior edge providing in combination with said shell said seal between said cylinder and said manifolds.

15. The internal combustion engine according to claim 8 wherein said concave and convex portions provide said further portion of said shell with a sine-wave cross-section.

16. The internal combustion engine according to claim 8 wherein said shell forms a closed interior.

17. An internal combustion engine valve comprising:

a shell having a spherical section and a truncated section, said truncated section having a concave portion and a convex portion, said shell defining a hollow interior; and a core filling said hollow interior, said core being a substance of high thermal conductivity.

18. The internal combustion engine valve according to claim 17 wherein said concave portion and said convex portion of said truncated section provide said truncated section of said shell with a sine-wave cross-section.

19. The internal combustion engine valve according to claim 17 wherein said shell forms a closed interior.

20. The internal combustion valve according to claim 17 wherein said high thermal conductivity substance is a liquid salt.

21. The internal combustion valve according to claim 17 wherein said convex and said concave portions abut to define a wavelike surface.

22. The internal combustion valve according to claim 21 further including a shaft therethrough, said shaft having a longitudinal axis for rotating thereabout.

23. The internal combustion valve according to claim 22 wherein said shaft axis passes through a center of said spherical shell.

24. In an internal combustion engine having at least one combustion chamber with a predefined diameter housing a piston linearly moveable therein in turn throughout successive intake, compression, power, and exhaust strokes the combination of a rotary valve mounted at a head of said combustion chamber for alternately facilitating the inflow of intake air from an intake manifold during said intake stroke, sealing said cylinder from said intake manifold and an exhaust manifold during said compression and said power strokes, and facilitating the exhaust of exhaust gasses from said cylinder to said exhaust manifold during said exhaust stroke, said valve comprising:

a shell having a spherical section and a truncated section, said truncated section having a concave portion and a convex portion, said shell defining a hollow interior; and a core filling said hollow interior, said core being a substance of high thermal conductivity.

25. The internal combustion engine according to claim 24 wherein said high thermal conductivity substance is a liquid salt.

26. The internal combustion engine according to claim 24 wherein said convex and said concave portions abut to define a wavelike surface.

27. The internal combustion engine according to claim 26 further including a shaft therethrough, said shaft having a longitudinal axis for rotating thereabout.

28. The internal combustion engine according to claim 27 wherein said shaft axis passes through a center of said spherical shell.

29. The internal combustion engine according to claim 28 wherein said spherical valve rotates above said cylinder and in combination with a seat, seals said cylinder from said manifolds during said compression and power strokes.

30. The internal combustion engine according to claim 29 wherein said seat further includes:

a chamfered area between said cylinder and said manifolds and defining at least one groove about a circumference of said chamfered area;

at least one sealing ring received within said groove and having an interior edge thereof extending interiorly toward a center of said chamfered circumference, said interior edge providing in combination with said shell said seal between said cylinder and said manifolds.

31. The internal combustion engine according to claim 24 wherein said concave portion and said convex portion of said truncated section provide said truncated section of said shell with a sine-wave cross-section.

32. The internal combustion engine according to claim 24 wherein said shell forms a closed interior.

* * * * *

UNITED STATES PATENT AND TRADEMARK OFFICE

CERTIFICATE OF CORRECTION

PATENT NO. : 6,415,756 B1
DATED : July 9, 2002
INVENTOR(S) : Jung W. Lee

It is certified that error appears in the above-identified patent and that said Letters Patent is hereby corrected as shown below:

Column 4,
Line 51, change “wavelike” to -- wave --.

Column 5,
Line 20, change “wavelike” to -- wave --.

Column 6,
Lines 3 and 34, change “wavelike” to -- wave --.

Signed and Sealed this

Thirty-first Day of August, 2004

JON W. DUDAS
*Director of the United States Patent and Trademark Office*